US006439549B1

(12) United States Patent
Lööv

(10) Patent No.: US 6,439,549 B1
(45) Date of Patent: Aug. 27, 2002

(54) PRESSURE CONTAINER FOR BATCH GASIFICATION OF LIQUID

(75) Inventor: Torsten Lööv, Rättvik (SE)

(73) Assignee: Drinkit International AB, Rattvik (SE)

( * ) Notice: Subject to any disclaimer, the term of this patent is extended or adjusted under 35 U.S.C. 154(b) by 0 days.

(21) Appl. No.: 09/673,611

(22) PCT Filed: Apr. 22, 1999

(86) PCT No.: PCT/SE99/00652

§ 371 (c)(1),
(2), (4) Date: Nov. 15, 2000

(87) PCT Pub. No.: WO99/54251

PCT Pub. Date: Oct. 28, 1999

(30) Foreign Application Priority Data

Apr. 22, 1998 (SE) ..... 9801416

(51) Int. Cl.[7] ..... B01F 3/04

(52) U.S. Cl. ..... 261/121.1; 261/DIG. 7; 99/323.1

(58) Field of Search ..... 261/121.1, DIG. 7; 426/477; 99/323.1, 323.2

(56) References Cited

U.S. PATENT DOCUMENTS 4,251,473 A * 2/1981 Gilbey ..... 261/121.1
4,509,569 A * 4/1985 Adolfsson ..... 99/323.1
4,588,536 A * 5/1986 Adolfsson ..... 2621/121.1
4,655,124 A * 4/1987 Child ..... 99/323.2
4,660,740 A * 4/1987 Brandon, Jr. et al. .. 261/DIG. 7

FOREIGN PATENT DOCUMENTS

WO WO 82/04243 * 12/1982
WO WO 82/04244 12/1982
WO WO 84/00352 2/1984

* cited by examiner

*Primary Examiner*—C. Scott Bushey
(74) *Attorney, Agent, or Firm*—Sughrue Mion, PLLC

(57) ABSTRACT

A pressure container for batch gasification of liquid includes a container filling opening (9) in its upper part and has mounted therein a float arrangement (8) for closing the container filling opening when a certain liquid level (7) is reached, a beverage dispensing opening (3), and a gas nozzle (20) which discharges into the container. The container (5) is indivisible and includes a side-wall opening (27). The gas nozzle (20) is fixed in a mounting base (31) that can be inserted into the container through the side-wall opening (27) and secured firmly in a position in which the edges of the base (31) lie sealingly against the inner container surface surrounding the opening. That part of the mounting base (31) located on the inside of the container (5) is provided with a mechanism for pivotal attachment of the float arrangement.

7 Claims, 4 Drawing Sheets

PRESSURE CONTAINER FOR BATCH GASIFICATION OF LIQUID

BACKGROUND OF THE INVENTION

The present invention relates to a pressure container for batch-wise gasification of liquid, said container including a container filling opening in the upper part of said container, a float arrangement mounted in the container for closing the filling opening at a given level of liquid in the container, a dispensing opening, and a gas nozzle which discharges into the container.

Pressure containers of this kind are intended particularly for use in appliances employed in the production of carbonized beverages, for instance in the home. Known appliances that include such a container are described in WO 82/04243, WO 82/04244 and WO 84/00352.

The appliances according to these publications include a plastic pressure container. As is evident from FIG. 1 of WO 84/00352, the container includes an upper top part 11 into which there is screwed a lower cylindrical part 4. Two container parts are necessary in order to be able to fit the components in the container. Consequently, in order to obtain a safe appliance high demands are placed on the screw connection between the two container parts, therewith complicating and adding to the expense of such appliances.

SUMMARY OF THE INVENTION

The primary object of the present invention is to provide a pressure container that can be used in appliances of the aforedescribed kind while fulfilling the safety requirements that may be placed on such a container. The mechanical strength of the container shall not be impaired with time and the container shall be hygienic in use.

The invention is based on the understanding that these objects can be realized with a steel pressure vessel in the form of an indivisible container that has as few and as small openings as possible, this in view of the fact that all openings constitute weakenings in the construction.

Because it is desired to use small openings in the pressure vessel, the invention must also solve the problem of enabling those components that are to be located inside the vessel, among other things the float arrangement, to be fitted to said vessel.

The particular characteristic features of a pressure container of the kind defined in the first paragraph are that the container is indivisible and provided with a side-wall opening, that the gas nozzle is fixed in a mounting base that can be inserted into the container through said opening and locked firmly in a position in which the edges of the mounting base lie in sealing engagement with the inner container surface surrounding said opening, and that the part of the mounting base located on the inside of the container is provided with means for pivotal attachment of the float arrangement.

A container of this kind may be made of steel. This provides a container which has a high mechanical strength that will not be impaired with time and which will also be very hygienic in use. The combination of the float arrangement with the gas nozzle mounting base also solves the problem of mounting the float in the container.

It is preferred that the mounting base has a configuration which will enable the base with the float affixed thereto to be inserted through the opening in the centre part of the container in a specific orientation relative to said opening, and to enable the base to be turned in the container and caused to fully cover the opening with the edge portion of the base pressed sealingly against the inner container surface surrounding said opening with a force that increases with the pressure in the container.

In one preferred embodiment of the invention, the container side wall is generally circular-cylindrical and merges with a dome-shaped bottom part that has a central dispenser opening and the gas nozzle is directed so that the gas jet will strike the inner container wall over a part that lies generally at the transition between said parts and the central dispensing opening.

BRIEF DESCRIPTION OF THE DRAWINGS

The invention will now be described in more detail with reference to an exemplifying embodiment thereof and also with reference to the accompanying drawings.

DETAILED DESCRIPTION OF THE PREFERRED EMBODIMENTS

Figure 1:
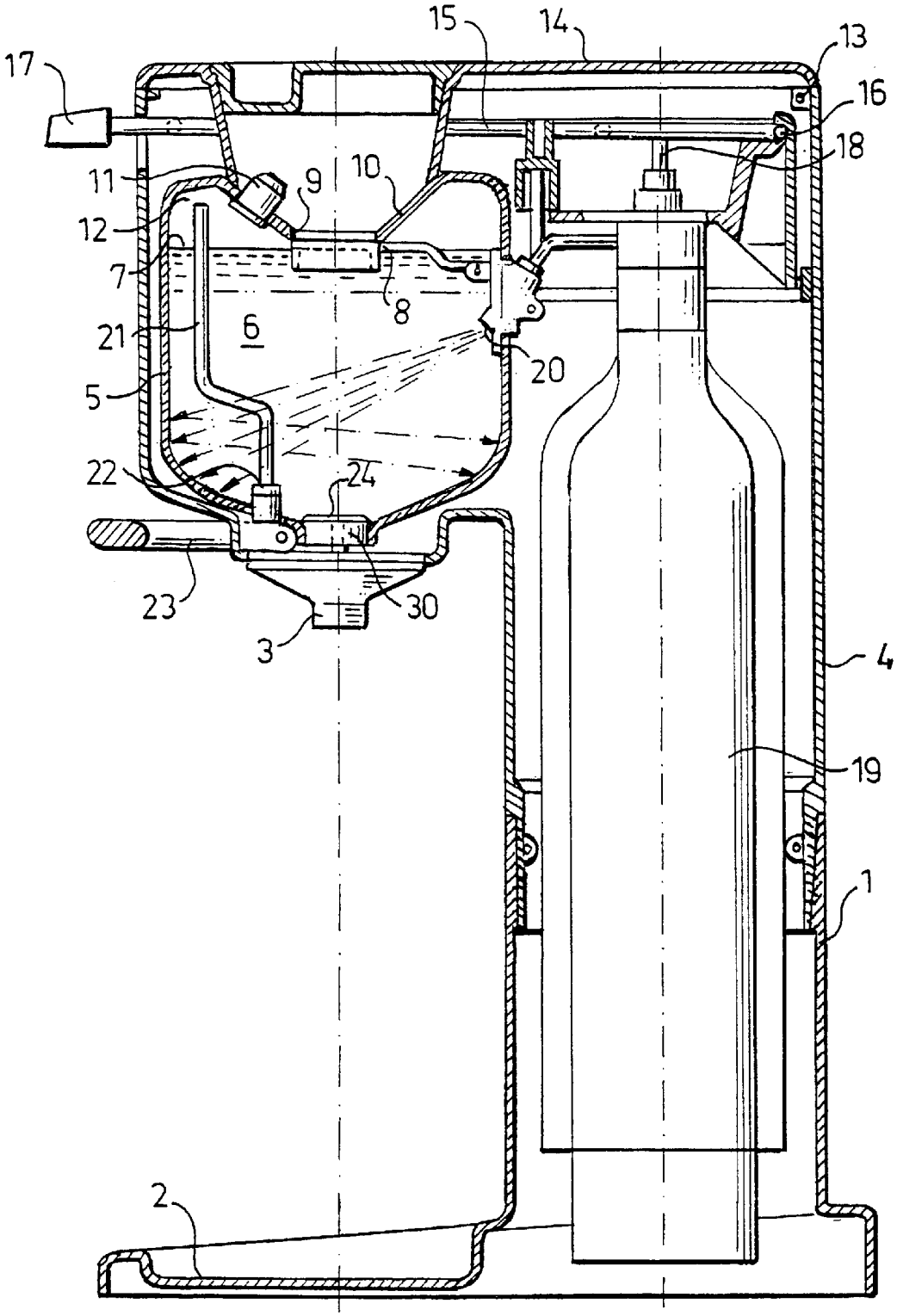
FIG. 1 is a sectioned view of an appliance for preparing carbonated beverages and comprising a pressure container constructed in accordance with the invention.

In FIG. 1, the reference numeral 1 identifies the lower part of a plastic casing of an appliance intended for the batchwise preparation of carbonated beverages. The reference numeral 2 identifies a plate on which there can be placed a drinking glass into which carbonated, or aerated, water shall be dispensed through an opening 3. The reference numeral 4 identifies the upper part of the plastic casing, which can be connected to the bottom part 1 through the medium of a snap-coupling.

The appliance includes a pressure container 5 which, in the illustrated case, is filled with liquid 6 to a level 7. The float arrangement 8 has been lifted by the liquid so as to close a container filling opening 9 in a funnel-shaped upper part 10 of the container 5. The reference numeral 11 identifies an overpressure valve which is in constant connection with a gas-filled space 12 above the liquid surface 7. The valve 11 opens when the pressure in the gas space 12 exceeds a preset value, e.g. 12 bar.

The plastic casing 4 also includes a lid 14 which can be swung about a pivot 13 and which closed in the FIG. 1 illustration. The reference numeral 15 identifies a maneuvering rod which can rotate about a pivot 16 and which carries an actuator 17. When the actuator 17 is pressed downwards, the rod 15 will cause a valve body 18 to open the dispensing valve of a carbonic acid container 19. Carbonic acid is then delivered from the container 19 to the liquid 6 in said container 5, via a gas nozzle 20.

The container 5 also includes a gas conduit or pipe 21 that connects the gas space 12 above the liquid surface 7 with a combined overpressure and equalizing valve 22 fitted in the lower part of the container 5. The valve 22 may be set to a slightly higher pressure than the pressure relief valve 11, e.g.

to a pressure of 14 bar, so as to function as a safety valve in the event of the valve 11 malfunctioning.

The valve 22 is constructed so that it can be forced open, by actuating a generally U-shaped opening device 23. The valve opening device 23 is intended to cause a bottom valve 24 to open when wishing to dispense carbonated water into a drinking glass placed on the plate 2.

The aforedescribed appliance is used in the following manner. Firstly, the lid 14 is raised and water poured down through the opening 9 in the funnel-shaped part 10. The bottom valve 24 is kept closed during this stage. As the level of liquid rises, the float 8 will be lifted and closes the opening 9 at the illustrated level 7, therewith preventing the delivery of further water to the container. The maneuvering device 17 is therewith pressed down, causing pressurized carbonic acid to be delivered to the water 6 in the container 5, through the nozzle 20. The container cannot be pressurized if it is not filled to the illustrated level 7, since gas would then pass out through the opening 9. This is an important safety aspect.

When the amount of gas delivered is sufficient for the pressure in the space 12 above the liquid surface 7 to reach the value to which the valve 11 is set, the valve will open and therewith emit a sound signal. This indicates that no further gas can be delivered to the container.

The carbonated, or aerated, water is dispensed by actuating the U-shaped valve opening device 23. This device is connected to the bottom valve 24 via a resilient arm (not shown) which is unable to open the bottom valve against the high pressure existing in the container 5. If it were possible to open the bottom valve at said high pressure, the liquid would be ejected from the container at such a high velocity as to prevent it from being gathered in an underlying drinking glass. For this reason, the opening device 23 is connected to the valve 22 so that said valve will be opened forcibly when actuating said device. The pressure in the container 5 will therewith be equalized to ambient atmospheric pressure via the gas conduit 21. Subsequent hereto, the spring force acting on the bottom valve 24 will be able to open the valve and allow the carbonated water to run down into an underlying drinking glass in a controlled manner, without splashing out of the glass.

Figure 2:
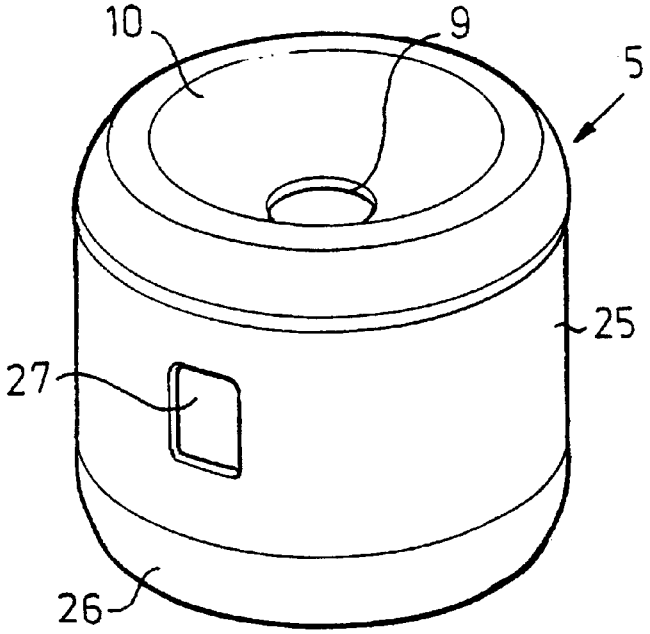
FIG. 2 is a perspective view of an inventive pressure container.
Figure 3:
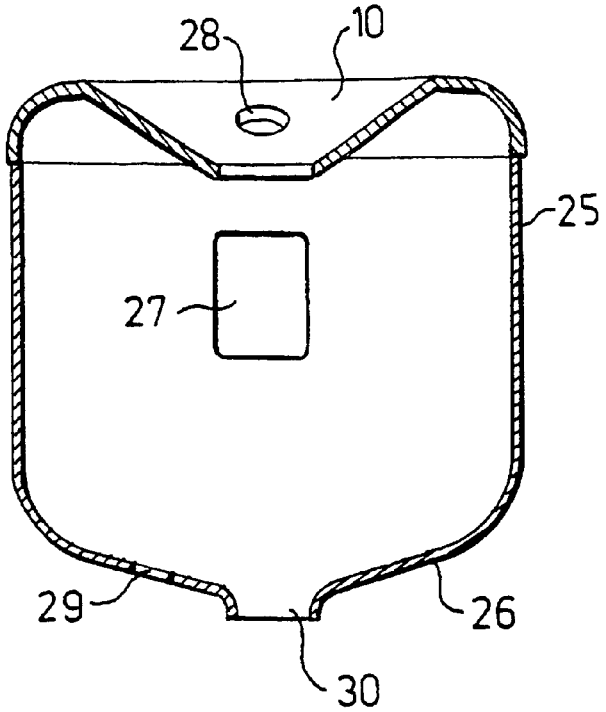
FIG. 3 is a sectioned view of the container shown in FIG. 2.

With the intention of providing a pressure container 5 of high mechanical strength which will not become impaired with time, and a container which is hygienic in use, it is proposed in accordance with the invention that the container is made of stainless steel. The shape of the container is shown in FIGS. 2 and 3, from which it will be seen that the container includes a generally circular-cylindrical centre part 25 which merges with a dome-like bottom part 26. The parts 25 and 26 are formed integrally with one another and may have a thickness of 1.5 mm. The top of the container is comprised of a funnel-shaped part 10 which is welded firmly to the centre part 25 and has a thickness of 3.0 mm. The illustrated form is practical to use and imparts high mechanical strength to the container. In order to retain this mechanical strength, the holes required must be both as few as possible and as small as possible. Accordingly, the inventive container is provided with only one relatively small opening 27 in the cylindrical centre part 25 and with a respective small hole 28, 29 in the top container part and the bottom container part respectively, in which the respective overpressure valves 11 and 22 are fitted. The container must, of course, include a container filling opening 9 and a beverage dispensing opening 30.

The opening 27 in the centre part of the container is intended for mounting the gas nozzle 20. Because the invention requires a float arrangement 8 to be pivotally mounted in the container, the float arrangement is combined with the gas nozzle in a manner such as to enable the float arrangement to be inserted into the container and guided therein with the aid of an arm which is pivotally connected to a gas nozzle mounting base.

Figure 4:
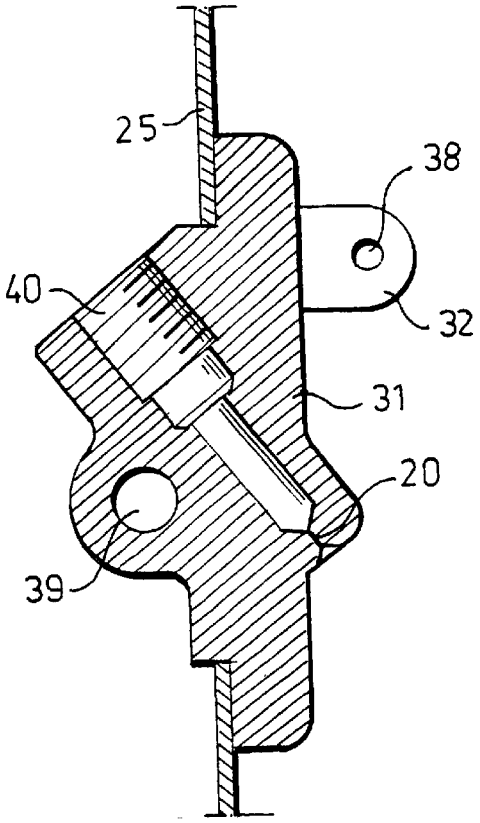
FIG. 4 is a sectioned view showing a mounting base inserted in an opening provided in the container wall.
Figure 5:
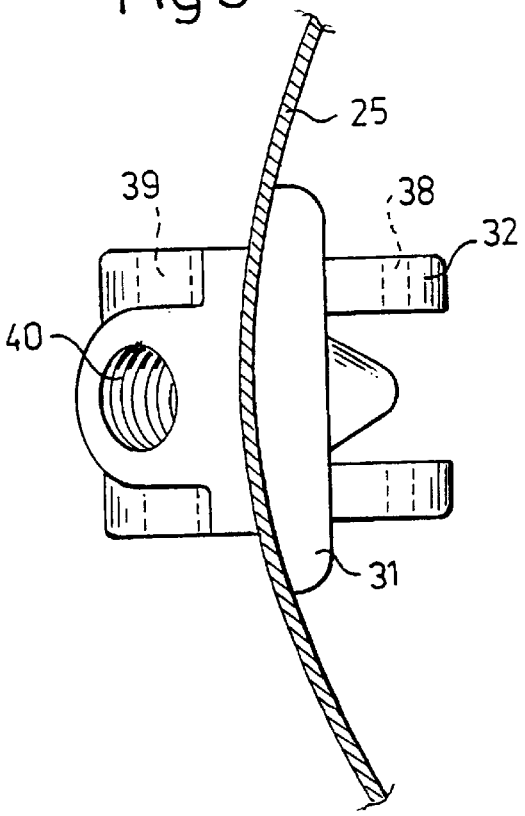
FIG. 5 shows the mounting base from above.
Figure 6:
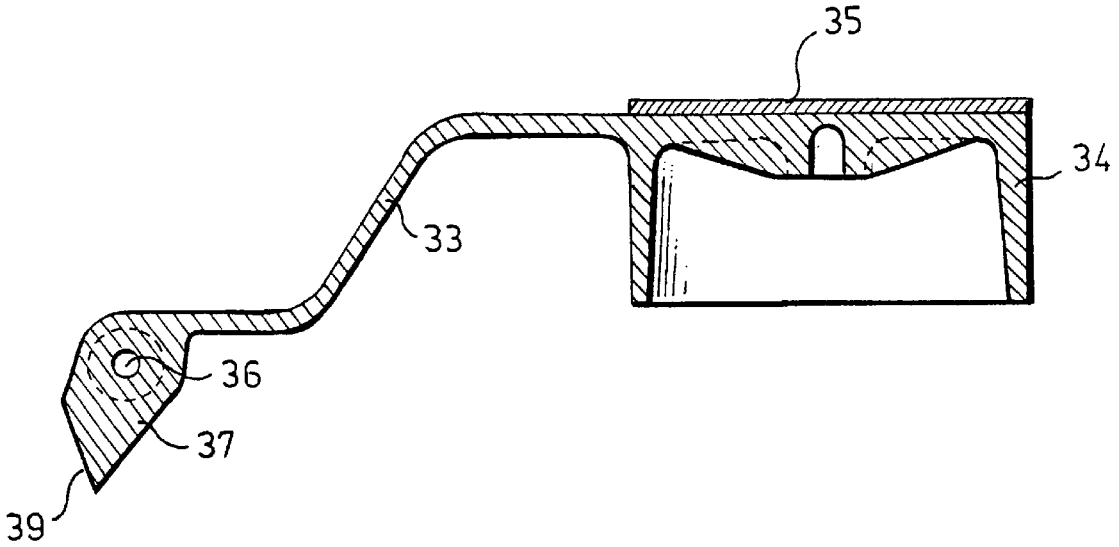
FIG. 6 is a section view of a float arrangement intended to be mounted on said base.
Figure 7:
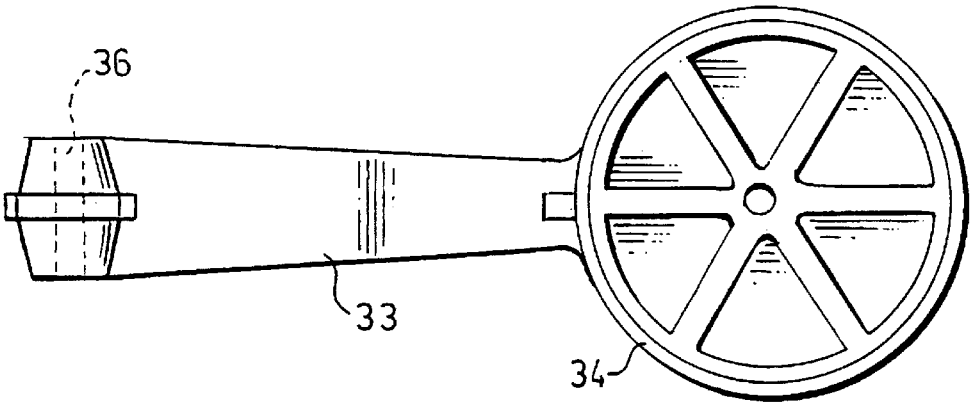
FIG. 7 shows the float arrangement from beneath.

As will be seen from FIGS. 4 and 5, the gas nozzle 20 is formed in a flat, plastic base plate 31 that has a curvature corresponding to the curvature of the circular-cylindrical part 25 of the container 5. The base plate 31 is provided on its inner surface with mounting lugs 32 for pivotal attachment of an arm 33 to a cup-shaped float body 34, see FIGS. 6 and 7. The cupped float body 34 is downwardly open and includes on its upper surface sealing material 35 for sealing against the edge of the opening 9 in the container 5.

The base plate 31 and the float arrangement are fitted in the container in the following manner. The float arrangement is first pivotally fitted to the base plate 31 with the aid of a pivot pin that passes through the hole 36 in an enlarged end-part 37 of the float arm 33 and through a corresponding hole 38 in the mounting lugs 32 of the mounting plate 31. The enlarged part of the float arm 33 has a rear edge 39 which coacts with the base plate 31 to prevent the float arrangement from being swung fully downwards.

The opening 27 in the centre part 25 of the container is dimensioned so that the base plate 31 together with the float arrangement 33, 34 projecting outwardly therefrom can be inserted through the opening 27 when said base plate has a specific position of orientation in relation to said opening. When the base plate is located in the container, the base plate is turned so as to fully cover the opening 27. The base plate is tightened, or tensioned, in this position with the aid of a locking device that passes through a hole 39 in the base plate. A gas conduit is then connected to the hole 40 in the plate.

This mounting method thus enables a pivotal float arrangement to be mounted in the container 5, in spite of the fact that the container solely has a very small side-opening 27, without the use of fastener lugs or the like on the inner container surface, which would otherwise greatly complicate manufacture of the container with a corresponding cost increase. Furthermore, it would be extremely difficult to mount the float arrangement.

Application of the invention also avoids any sealing problems, since the base plate 31 seals against the inner surface of the container wall, wherewith the higher the container pressure the harder the base plate is pressed against said inner surface. The sealing pressure is thus adjusted in accordance with prevailing requirements.

The illustrated form of the container 5 with its dome-shaped bottom part, and the placement of the gas nozzle in the container wall enables the nozzle to be directed so that the gas jets will strike against the side-wall and the bottom part of the container at angles which result in highly effective disintegration of said jets; c.f. for instance the arrows in FIG. 1.

The use of a plastic mounting base plate 31 enables the gas nozzle 20 to have the form of a bore through the plate, which further simplifies and lowers the cost of the appliances.

Although the invention has been described above with reference to an illustrated exemplifying embodiment thereof and also with reference to the accompanying drawings, it will be understood that several modifications can be made within the scope of the following claims. For instance, the form of the base plate and gas nozzle can be varied as desired. Furthermore, floats that have types of buoyant bodies other than cup-shaped bodies may be used.

What is claimed is:

1. A pressure container for batchwise gasification of liquid, said container including a container filling opening (9) in the upper part of said container, a float arrangement (8) mounted in the container (5) and functioning to close the filling opening when a certain liquid level (7) is reached in the container, a dispensing opening (3), and a gas nozzle (20) which discharges into said container, characterized in that the container (5) is indivisible and includes an opening (27) in a side-wall (25) of said container; in that the gas nozzle (20) is fixed in a mounting base (31) which can be inserted into the container through said side-wall opening (27) and locked firmly in a position in which the edges of said base (31) lie sealingly against the inner container surface that surrounds the opening; and in that the part of the mounting base (31) located inside the container (5) includes means for the pivotal attachment of said float arrangement (8).

2. A pressure container according to claim 1, characterized in that the shape of the mounting base (31) is such as to enable it to be inserted through said sidewall opening (27) with the float (8) attached to said base and with the base in a specific position of orientation relative to said opening such as to enable the base to be turned in the container (5) and therewith caused to fully cover said opening (27) and such that the edge portion of said base will be pressed sealingly against that part of the container wall defining said opening with a force that increases with container pressure.

3. A pressure container according to claim 1, characterized in that the side-wall (25) of the container is generally circular-cylindrical in shape and merges with a bottom part (26) that includes a central beverage dispensing opening (30); and in that the gas nozzle (20) is directed so that the gas jets will strike the inner container wall over an area located generally between a transition region of said side-wall and said bottom part (25, 26) and the central dispensing opening (30).

4. A pressure container according claim 1, characterized in that the container (5) is made of stainless steel and comprises two mutually welded parts.

5. A pressure container according to claim 1, characterized in that the mounting base (31) is comprised of plastic material; and in that the gas nozzle (20) has the form of a bore through said base.

6. A pressure container according to claim 1, characterized in that the float arrangement includes a pivotal arm (33) whose one end is pivotally connected to the base part (31) and whose other end supports a float body (34) that has a flat upper side (35) for sealing pressure abutment with the filling opening (9).

7. A pressure container according to claim 6, characterized in that the float body (34) has the form of a downwardly open cup.

* * * * *